United States Patent [19]

Grider et al.

[11] Patent Number: 4,775,333

[45] Date of Patent: Oct. 4, 1988

[54] METHOD OF ASSEMBLING AN IMPROVED ELECTRICAL CONNECTOR

[75] Inventors: Duane M. Grider, Detroit; Charles L. Henritzy, Grosse Pointe Farms; Jacque C. Warnars, Roseville, all of Mich.

[73] Assignee: Ford Motor Company, Dearborn, Mich.

[21] Appl. No.: 812,411

[22] Filed: Dec. 23, 1985

[51] Int. Cl.[4] ..... H01R 13/504

[52] U.S. Cl. ..... 439/736; 264/277; 439/937

[58] Field of Search ..... 339/218 M, 218 R, 66 R, 339/66 M, 66 T, 65, 276 SF; 439/374, 375, 710, 701, 736, 885, 722, 937, 686, 695; 264/23, 254, 277, 272.14

[56] References Cited

U.S. PATENT DOCUMENTS

| | | | |
|---|---|---|---|
| 3,154,631 | 10/1964 | Mauviel | 439/701 |
| 3,170,752 | 2/1965 | Van Horssen | 339/217 |
| 3,206,717 | 9/1965 | Brown et al. | 339/205 |
| 3,430,185 | 2/1969 | Sitzler et al. | 339/59 M |
| 3,500,295 | 3/1970 | Faber et al. | 339/218 M |
| 3,937,545 | 2/1976 | Cairns et al. | 339/60 R |
| 4,030,799 | 6/1977 | Venaleck | 339/218 M |
| 4,105,278 | 8/1978 | Braund et al. | 339/218 M |
| 4,124,264 | 11/1978 | Kato et al. | 339/59 M |
| 4,125,313 | 11/1978 | Sipp et al. | 339/218 M |
| 4,128,293 | 12/1978 | Paoli | 339/258 R |
| 4,169,649 | 10/1979 | Henley et al. | 339/65 |
| 4,200,347 | 4/1980 | Sinclair et al. | 339/66 M |
| 4,422,708 | 12/1983 | Birnholz | 339/65 |
| 4,469,387 | 9/1984 | McHugh | 339/66 M |
| 4,602,831 | 7/1986 | Lockard | 439/736 |

*Primary Examiner*—Gil Weidenfeld
*Assistant Examiner*—Gary F. Paumen
*Attorney, Agent, or Firm*—Paul K. Godwin, Jr.; Clifford L. Sadler

[57] ABSTRACT

A method of assembling an electrical pin connector utilizing a molded carrier element to support and hermetically seal a number of preoriented and spacially disposed electrical pin connectors prior to inserting the carrier into a correspondingly shaped aperture of a shell housing and bonding the carrier to the shell housing to provide a hermetic seal thereto.

7 Claims, 2 Drawing Sheets

METHOD OF ASSEMBLING AN IMPROVED ELECTRICAL CONNECTOR

BACKGROUND OF THE INVENTION

1. Field of the Invention

The present invention is directed to the field of electrical connectors and more specifically to the area of assembly techniques for such connectors.

2. Description of the Prior Art

In multi-pinned shell housing electrical connectors, such as those suitable for use in high moisture environments, the common assembly technique is to first provide the shell housing with a plurality of axially extending apertures and internal compression members for latching subsequently inserted electrical terminals. Electrical terminals, commonly connected to insulated wires, are then inserted, one by one, into the appropriate apertures provided in the shell housing where they are latched in place by the internally formed compression members.

U.S. Pat. Nos. 3,170,752; 3,206,717; 3,430,185; 4,124,264; and 4,128,293 are each representative of prior art assembly techniques in which the electrical pin connectors are individually inserted into the shell housing apertures and latched in place by internal means within the housing.

Commonly assigned U.S. Pat. No. 3,937,545 generally illustrates the above described technique and, in addition, illustrates the use of an elastomeric material containing apertures corresponding to the number of electrical pin connectors in the shell housing, whereby the elastomeric material is compressed within the shell housing. The insulated wires are threaded through the elastomeric apertures and compressibly held to prevent the migration of moisture along that interface and into the electrical contact portion of the connector.

SUMMARY OF THE INVENTION

In contrast to the described prior art assembly technique, the present invention offers an improved method of assembly which eliminates the laborious and time consuming effort of tooling molds with relatively complicated internal latching members and of inserting individual pin connectors into the shell housing apertures.

The present invention allows for the individual pin connectors to be prepositioned and molded into a carrier element. The carrier element is formed to a predetermined shape which matches that of a corresponding aperture in a connector shell housing. The carrier element containing its pin connectors is inserted into the shell housing and bonded thereto to provide a secure and hermetic seal.

It is, therefore, an advantage of the present invention to provide an assembly technique whereby hermetic sealing of an electrical connector is achieved without the use of elastomers and other sealing devices.

It is another object of the present invention to provide an assembly technique whereby a plurality of electrical pin connectors may be simultaneously inserted into the rear of a shell housing in a prearranged distribution on a common carrier element.

DETAILED DESCRIPTION OF THE PREFERRED EMBODIMENTS

Figure 1:
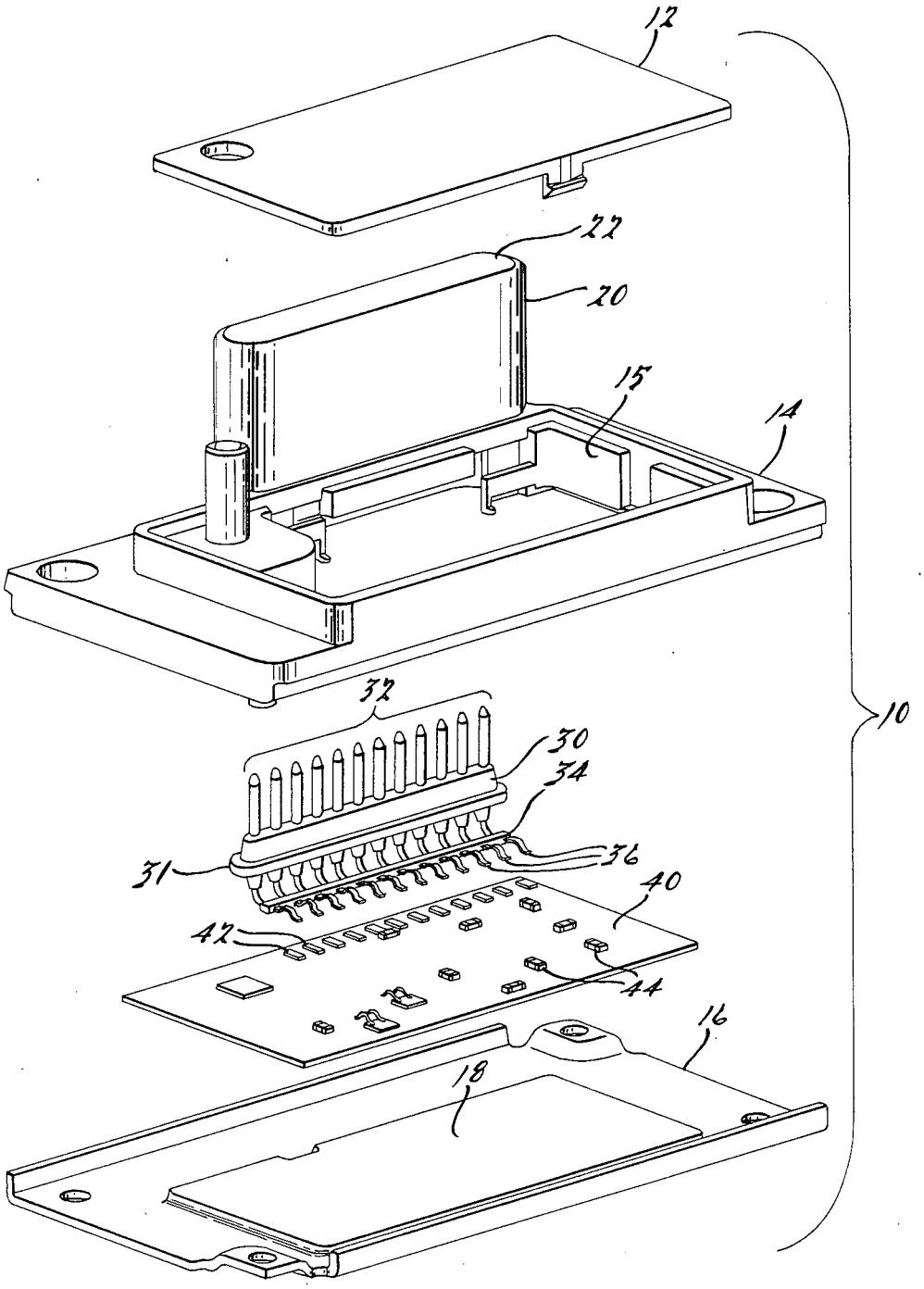
FIG. 1 is an exploded view of an embodiment incorporating the present invention.
Figure 2:
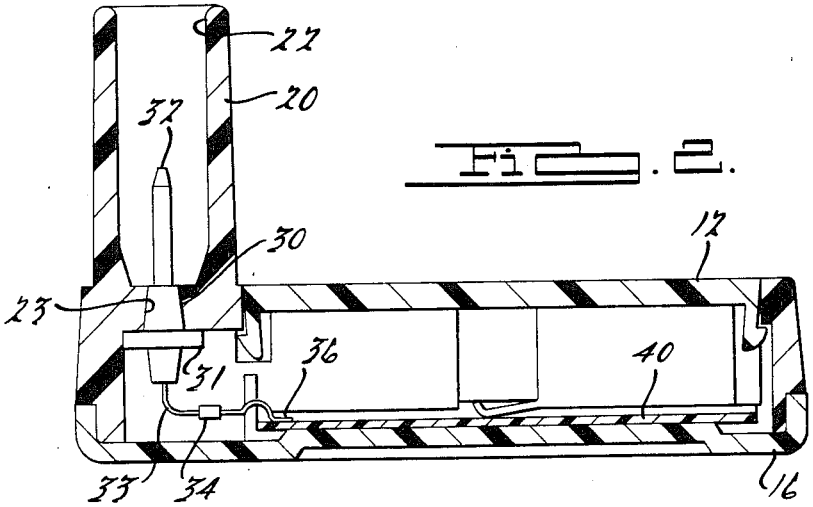
FIG. 2 is a cross-sectional view of the first embodiment assembly shown in FIG. 1.

FIGS. 1 and 2 illustrate a first embodiment which incorporates the present invention in an assembly 10. The assembly 10 includes a base member 16, a housing 14 and a cover 12. The base member 16 has a raised platform 18 onto which an insulated printed circuit board 40 is located. Printed circuit board 40 has a number of circuit elements 44 (the details of which are not relevant to this disclosure) and electrical contact pads 42.

The housing 14 has a major aperture 15 into which access may be obtained to the printed circuit board 40 by removal of the cover 12. The housing 14 further includes an electrical connector shell housing 20 which is preferably formed of an electricaly insulative material with a major opening 22 for receiving a mating electrical connector.

Electrical pin conductors 32 are each formed of an electrically conductive material so as to have an exposed first end portion suitable for contact with a female electrical conductor (female not shown) and for mating therewith. The second end portion of each electrical pin conducor 32 is formed as an electrical terminal 36 that is suitable for being soldered directly to corresponding ones of the conductor pads 42. In other installations, the electrical terminal ends 36 could be of the type suitable for crimping onto wire conductors, as is conventionally known.

In FIGS. 1 and 2, the electrical pin conductors 32 are shown as mounted in an insulated carrier 30 which is sized to conform to the aperture 23 at the base of the shell housing 20. In addition, an insulated support member 34 is molded so as to interconnect the terminal ends 36 of the pin conductors 32 and keep them aligned in a common plane for subsequent soldering to the electrical terminal pads 42 on the printed circuit board 40.

The carrier 30 is configured in the described embodiment as having a tapered portion which corresponds to the tapered shape of the aperture 23 in the shell housing 20 and has a flange 31 extending around its periphery. The carrier 30 is a low pressure injection molding which is formed, with a high dielectric insulating material such as a thermosetting plastic. After the pin connectors 32 are temporarily held in a predetermined orientation and spacial relationship, the carrier element 30 is formed about the mid-portions 33 of the pin connectors so as to surround, seal and provide a rigid support for each of the pin connectors in the assembly.

In the embodiment shown in FIGS. 1 and 2, the electrical pin connectors 32 are evenly spaced in a linear configuration so as to have their electrical terminal ends 36 disposed in a parallel relationship. It is foreseen, however, that the pin connectors could also be distributed in any other arrangement and a suitable carrier could be molded to conform to the appropriate shell housing aperture.

The support element 34 may be molded to retain terminal ends 36 in their desired orientation prior, during or subsequent to the molding of the carrier element 30.

Upon insertion into the aperture 23 of the shell housing 20, the carrier element 30 is bonded to the shell housing 20 so as to provide a hermetic seal at the aperture 23 and prevent moisture from permeating through that interface. Sonic welding has been found to be suitable for providing a high integrity seal in an automated assembly environment. In that method, an ultrasonic welding transducer is applied to the carrier 30 within the aperture 23 of the shell housing 20. Ultrasonic vibrations produced at the transducer cause frictional heat to develop between the opposing surfaces and the thermosetting plastic materials of the housing 20 adjacent the aperture 23 and the carrier element 30 will fuse.

Figure 3:
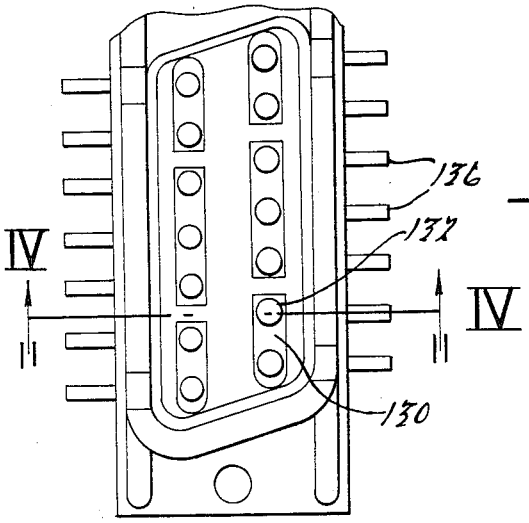
FIG. 3 is a second embodiment incorporating the present invention.
Figure 4:
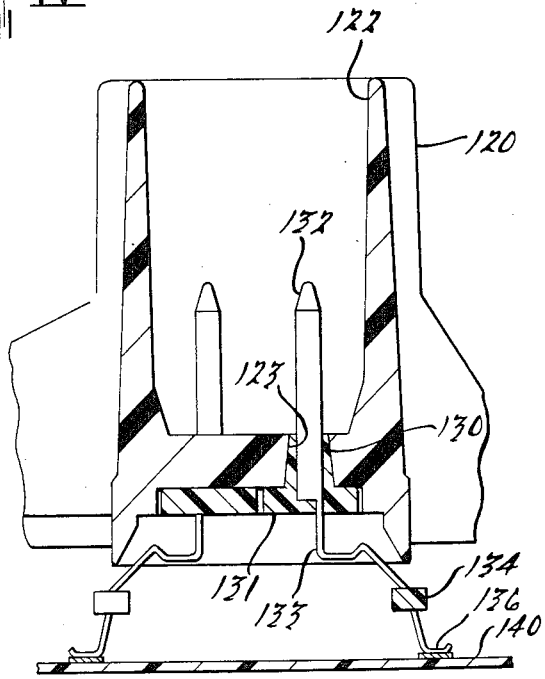
FIG. 4 is a cross-sectional view of the second embodiment taken along lines IV—IV of FIG. 3.

A second embodiment incorporating the present invention is shown in FIGS. 3 and 4. In that embodiment, a plurality of carriers 130 are bonded to the shell housing 120 of an electrical connector. The shell housing has a major opening 122 and a plurality of apertures 123 which are formed of a predetermined size to accept the carriers 130 containing the plurality of electrical pin connectors 132.

In each of the assembled connector embodiments shown in the figures, it should be appreciated that the assembly technique of utilizing an molded insulator carrier element to support a number of electrical pin connectors prior to the insertion of those connectors into a shell housing provides for the use of a simplified shell housing structure without internal molded locking structures and provides for hermetic sealing without the use of separate preformed elastomer elements. In addition, the method described eliminates the time consuming process of inserting each pin conductor precisely into a prescribed aperture on a one-at-a-time basis.

It will be apparent that many modifications and variations may be implemented without departing from the scope of the novel concept of this invention. Therefore, it is intended by the appended claims to cover all such modifications and variations which fall within the true spirit and scope of the invention.

We claim:

1. An electrical connector comprising:

a plurality of electrical contact elements, each having a first end portion suitable for mating with another electrical contact element, a second end portion defining an electrical terminal and a mid-portion between said first and second end portions;

a carrier element formed of a high dielectric insulative material molded about at least the mid-portion and exposing the first end portion of said contact elements;

a support member formed of a high dielectric insulative material molded about said electrical contact elements between said carrier element and said electrical terminal ends to retain said terminal ends in a predetermined spacial arrangement; and a connector shell housing with a first open end for mating with another connector shell housing and a second end containing at least one aperture for receiving said carrier element with said exposed first end portions of said electrical contact element oriented towards said first open end of said connector shell housing.

2. A connector as in claim 1, wherein said carrier element within the aperture of said connector shell housing is hermetically sealed with respect thereto.

3. A connector as in claim 2, wherein said carrier element is permanently fused within said aperture by use of an ultrasonic welding method.

4. A method of assembling an electrical connector comprising the steps of:

providing a plurality of electrical contact elements each having a first end portion suitable for mating with another electrical contact element, a second end portion defining an electrical terminal and a mid-portion between said first and second end portions;

temporarily securing said contact elements in a predetermined spacial arrangement;

molding a carrier element of a high dielectric material in a predetermined shape so as to surround and ridigly support at least the mid-portion of each temporarily secured contact element in said predetermined spacial arrangement and to expose at least said first end portion of each contact element;

molding a support member of a high dielectric material onto said contact elements between said carrier element and said electrical terminals to retain said terminals in a predetermined spacial arrangement;

providing a connector shell housing with at least one aperture corresponding to the shape of said molded carrier element;

mating said molded carrier element into said aperture in said connector shell housing; and bonding said molded carrier element to said connector shell housing.

5. A method as in claim 4, wherein said electrical terminals are disposed in a common plane for attachment to corresponding conductors on a printed circuit board.

6. A method as in claim 5, wherein said step of bonding said molded carrier element to said connector shell housing provides a hermetic seal between said carrier element and said shell housing.

7. A method as in claim 6, wherein said step of bonding utilizes an ultrasonic welding method to cause opposing surfaces of said carrier element and the aperture of said connector shell housing to be fused.

* * * * *